US007350505B2

(12) United States Patent
Felton

(10) Patent No.: US 7,350,505 B2
(45) Date of Patent: Apr. 1, 2008

(54) COMMON RAIL FUEL PUMP

(75) Inventor: George Nicholas Felton, Gillingham (GB)

(73) Assignee: Delphi Technologies, Inc., Troy, MI (US)

( * ) Notice: Subject to any disclaimer, the term of this patent is extended or adjusted under 35 U.S.C. 154(b) by 101 days.

(21) Appl. No.: 10/565,425

(22) PCT Filed: Jul. 16, 2004

(86) PCT No.: PCT/GB2004/003127

§ 371 (c)(1),
(2), (4) Date: Jan. 18, 2006

(87) PCT Pub. No.: WO2005/012720

PCT Pub. Date: Feb. 10, 2005

(65) Prior Publication Data

US 2006/0185648 A1 Aug. 24, 2006

(30) Foreign Application Priority Data

Jul. 18, 2003 (EP) ..... 03254500

(51) Int. Cl.
*F02M 57/02* (2006.01)
*F02M 37/04* (2006.01)

(52) U.S. Cl. ..... 123/446; 123/496

(58) Field of Classification Search ..... 123/506, 123/446

See application file for complete search history.

(56) References Cited

U.S. PATENT DOCUMENTS 4,167,168 A * 9/1979 Yamamoto ..... 123/467
5,551,398 A * 9/1996 Gibson et al. ..... 123/446
5,957,674 A 9/1999 Zenmei et al.
6,530,363 B1 3/2003 Blass et al.
6,595,189 B2 * 7/2003 Coldren et al. ..... 123/467
6,626,149 B2 * 9/2003 Hlousek ..... 123/447
6,637,410 B2 * 10/2003 Onishi et al. ..... 123/467
6,648,610 B2 * 11/2003 Williams ..... 417/307
6,651,625 B1 * 11/2003 Knight et al. ..... 123/446
2002/0040704 A1 4/2002 Onishi et al.

FOREIGN PATENT DOCUMENTS

EP 0481964 4/1992
EP 0957261 11/1999

* cited by examiner

*Primary Examiner*—Thomas Moulis
(74) *Attorney, Agent, or Firm*—David P. Wood

(57) ABSTRACT

A common rail fuel pump for an internal combustion engine includes a pumping plunger (10) that is reciprocable within a plunger bore (14) provided in a pump housing (16) under the influence of a drive arrangement (18, 20) to cause fuel pressurisation within a pump chamber (12). An inlet metering valve (46) is operable to meter the quantity of fuel supplied to the pump chamber (12) during the return stroke of the plunger (10). An outlet valve (58) controls the supply of pressurised fuel from the pumping chamber (12) through an outlet passage (30) to the common rail fuel volume in circumstances in which the inlet metering valve is closed. The outlet passage (30) has a pump outlet (38), from where fuel is supplied to the common rail fuel volume. The inlet metering valve (46), the plunger (10) and the pump outlet (38) are arranged in axial alignment, providing a compact and lightweight pump for installation in existing and purpose-built engines.

13 Claims, 2 Drawing Sheets

COMMON RAIL FUEL PUMP

Figure 1:
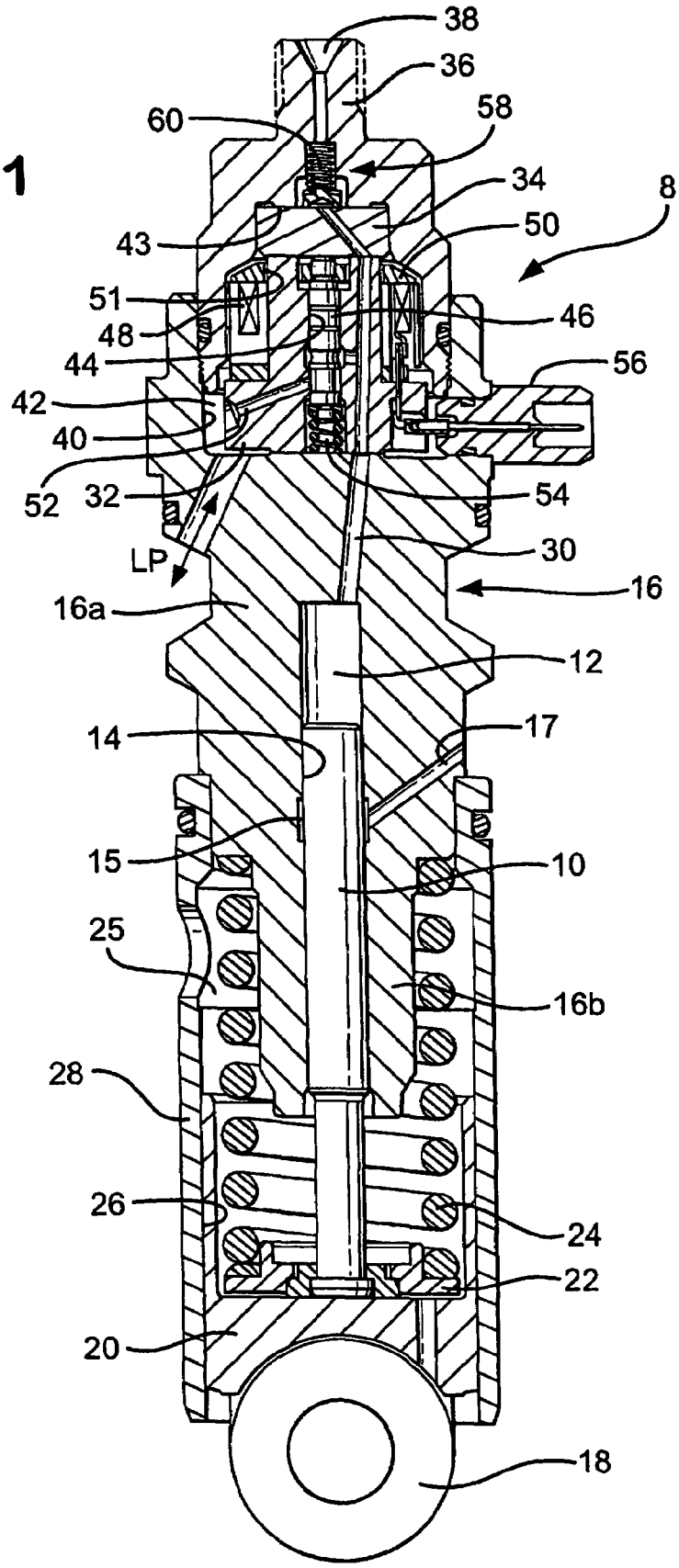

The present invention relates to common rail fuel pump suitable for use, in particular, in a fuel injection system of a compression ignition internal combustion engine. The invention also relates to a common rail fuel supply system for supplying fuel to a plurality of injectors of the engine.

In known common rail fuel injection systems for diesel engines, it is common to provide a single high pressure pump for supplying fuel at an injectable pressure level to a plurality of associated injectors. The high pressure fuel pump supplies pressurised fuel to an accumulator volume or common rail, which is arranged to supply fuel to all of the injectors of the system. Typically, each injector is provided with an electronically controlled nozzle control valve to control movement of a fuel injector valve needle and, thus, to control the timing of delivery of fuel from the injector. The high pressure pump is commonly of radial pump design and requires a "rotary" drive. Radial fuel pumps also occupy a relatively large accommodation space.

Other types of diesel fuel injection system are known in which a plurality of unit pumps are provided, each of which delivers fuel at high pressure to a separate high pressure fuel line and, from here, to a dedicated injector. Each unit pump typically includes a tappet that is driven by means of a cam to impart drive to a plunger, thereby causing the plunger to reciprocate and resulting in pressurisation of fuel within a pumping chamber of the unit. In such systems it is necessary to provide each engine cylinder with a set of separate pump components, the set consisting of a cam, a tappet, a unit pump, a high pressure line and an injector, with the cams for each set of pump components being formed on a common drive shaft.

The unit pumps are arranged "in a line" along the axis of the cam shaft, with a drive end of each unit pump co-operating with a lobe of its associated cam and the injection nozzle end of each unit pump being arranged to deliver fuel to the associated engine cylinder. Typically, the cam shaft has three lobes associated with each engine cylinder; one for driving the associated pumping plunger and the other two for controlling engine valve timing.

It has been recognised that unit pump injection systems of the aforementioned type have their disadvantages. For example, each unit pump typically functions by pressurising a substantially fixed volume of fuel during a pumping cycle, and then spilling pressurised fuel that is not required for an injection event to low pressure. This introduces system inefficiency. Additionally, the system has a high part count, and therefore is of relatively high cost, particularly as it requires one unit pump to be provided for each fuel injector.

Despite the drawbacks of unit pump injection systems, the machining and assembly line facilities for the manufacture of engine installations of this type are well established, and engine installations designed to accommodate this type of system are widely used.

The problem addressed by the present invention is to provide a common rail fuel pump which avoids or obviates the aforementioned disadvantages, whilst permitting continued use of production line facilities and engine installations that are already in existence.

According to a first aspect of the present invention there is provided a common rail fuel pump for supplying fuel to a common rail fuel volume of an internal combustion engine, the fuel pump comprising a pumping plunger that is reciprocable within a plunger bore provided in a pump housing under the influence of a cam drive arrangement to cause fuel pressurisation within a pump chamber, wherein the drive arrangement includes a cam driven drive member coupled to the plunger to impart drive thereto, in use, so that the plunger performs a pumping cycle including a pumping stroke and a return stroke. An inlet metering valve is operable to control the quantity of fuel supplied to the pump chamber during the return stroke of the plunger, and an outlet valve controls the supply of pressurised fuel from the pump chamber, through an outlet passage to the common rail fuel volume in circumstances in which the inlet metering valve is closed. The outlet passage communicates with a pump outlet which is substantially co-axially aligned with both the inlet metering valve and the plunger. Closure of the inlet metering valve part way through the plunger return stroke controls the quantity of fuel that is supplied to the pump chamber for pressurisation during a subsequent plunger pumping stroke and, hence, controls the quantity of high pressure fuel that is delivered to the common rail.

The present invention provides a convenient, small and relatively lightweight common rail fuel pump, particularly by virtue of the inlet metering valve itself forming an 'integral' part of the pump and being arranged in axial alignment with the plunger and the pump outlet.

The provision of the inlet metering valve provides a facility for inlet metering the quantity of fuel to be pressurised, if desired, and therefore avoids the requirement for a separate inlet metering valve to be provided for the pump assembly. A further benefit of the system is that it is compatible with existing engine installations and production line technology designed for unit pump injection systems, therefore providing cost benefits. The fuel system has particular application in relatively small industrial and agricultural engines, although it may also be used in larger engines.

It will be appreciated that the fuel pump pressurises fuel for supply to the injectors of the fuel injection system with which it is used, but does so via the common rail fuel volume. The pump outlet may be in direct communication with the common rail fuel volume, or optionally the pump outlet may communicate with the common rail fuel volume through additional pipework.

The drive arrangement typically includes a cam for driving the drive member and the plunger. If the fuel pump is intended for use in smaller engines (for example one, two or three cylinders) a single unit pump of the invention may be sufficient, with several lobes being provided on one cam if necessary. For larger engine applications (for example four, five or six cylinders), it may be necessary to provide a plurality of such unit pumps.

Preferably, the inlet metering valve of the pump includes an elongate, and preferably generally cylindrical, inlet valve member that is co-axially aligned with the plunger.

The outlet valve is preferably arranged within an outlet passage and the inlet metering valve is preferably housed within a valve housing which is received within a recess or opening provided in an end region of the pump housing so that respective drillings provided in the valve housing and the pump housing align to define, at least in part, the outlet passage.

Preferably, the outlet valve of the pump is a hydraulically operable non-return valve located within the outlet passage.

The fuel pump of the present invention is particularly versatile and has several optional modes of operation. In particular, the inlet metering valve may be operable in one of several ways so as to control the quantity of fuel that is pressurised within the pump chamber for delivery to the rail.

The inlet metering valve may be further operable so as to allow the pump chamber to be filled through the open valve during the plunger return stroke, with the inlet metering valve being maintained open for an initial period of the pumping stroke so that some of the fuel within the pump chamber is dispelled back to low pressure. The inlet metering valve is closed when it is required to initiate pressurisation of fuel within the pump chamber and is preferably opened again prior to a final period of the pumping stroke (i.e. prior to top-dead-centre). This method is advantageous as only a short period of valve actuation is required part way through the pumping stroke, providing an efficiency benefit and accurate control of the timing of fuel delivery to the rail. By opening the inlet metering valve again prior to the final period of the pumping stroke, Hertz stresses on the cam of the drive arrangement are also reduced.

The plunger bore of the pump assembly may also be provided with a filling port that is co-operable with the plunger to provide a filling function for the pump chamber, whereby when the plunger covers the filling port fuel is unable to flow into the pump chamber through the filling port and when the plunger uncovers the filling port fuel is able to flow into the pump chamber through the filling port.

The filling port may be defined at one end of a filling passage provided in the pump housing, wherein said filling passage communicates with a low pressure fuel reservoir.

The provision of the filling port and the filling passage provides a supplementary filling means for the pump chamber. This may be particularly advantageous if the supply pump for the system provides a supply pressure that is too low for filling through the inlet metering valve.

It will be appreciated that the common rail fuel pump may be manufactured and sold independently of the common rail fuel volume and other parts of the common rail fuel injection system or, alternatively, may be manufactured and sold as part of a complete fuel system.

Alternatively, therefore, according to a second aspect of the invention, there is provided a common rail fuel supply system for use in an internal combustion engine, the system including a common rail fuel volume for supplying fuel to a plurality of injectors of the engine, and a plurality of common rail fuel pumps of the first aspect of the invention, each pump being arranged to supply fuel through a respective pump outlet to the common rail fuel volume.

The common rail fuel pump of this second aspect of the invention may have any of the preferred and/or optional features of the first aspect of the invention.

According to a third aspect of the invention, there is provided a control method for a common rail fuel pump as set out in the accompanying claims, the method including holding the inlet metering valve open during the return stroke to permit fuel to be supplied to the pump chamber from a low pressure source, closing the inlet metering valve to permit pressurisation of fuel within the pump chamber during the subsequent pumping stroke, and opening the inlet metering valve prior to a final period of the pumping stroke so as to terminate pressurisation of fuel within the pump chamber and to ensure Hertz stresses on the cam are minimised.

In one embodiment, the invention includes closing the inlet metering valve after an initial period of the pumping stroke so as to dispel a proportion of fuel that is supplied to the pump chamber during the return stroke back to low pressure, so as to control the quantity of fuel which is pressurised within the pump chamber during the pumping cycle.

Figure 2:
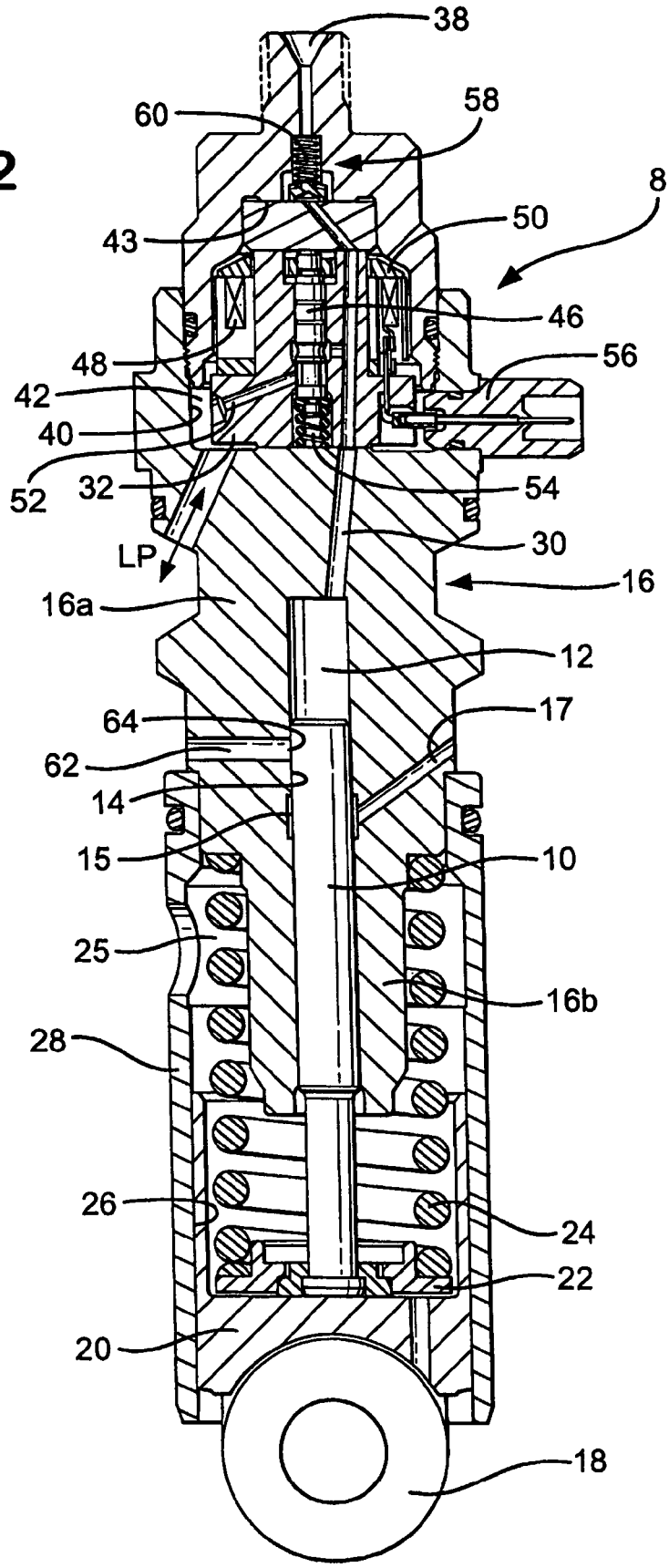

The invention will now be described, by way of example only, with reference to the following drawings in which:

FIG. 1 is a sectional view of a unit fuel pump of a first embodiment of the present invention, and FIG. 2 is a sectional view of a unit fuel pump of an alternative embodiment to that shown in FIG. 1.

Referring to FIG. 1, a common rail fuel pump assembly, or unit fuel pump, referred to generally as 8, includes a pumping plunger 10 which is driven, in use, to pressurise fuel within a pump chamber 12 defined at the end of a plunger bore 14 provided in a main or unit pump housing 16. The unit pump housing 16 includes an upper region 16*a* of enlarged diameter compared to a lower reduced diameter region 16*b*. The plunger 10 is movable within the bore 14 under the influence of a cam drive arrangement, including an engine driven cam (not shown), which is mounted upon or forms part of an engine driven shaft and co-operates with a roller and a tappet arrangement, 18, 20 respectively. The plunger bore 14 is provided with a groove 15 to enlarge its diameter part way along its axial length. The groove 15 communicates with a drain passage 17 so as to permit leakage fuel from the pump chamber 12 through the plunger bore 14 to escape to low pressure.

A roller 18 of the drive arrangement co-operates with the surface of the cam as it rotates, in use. A lower end of the plunger 10 (in the orientation shown) projects from the plunger bore 14 and is coupled at its end to the tappet 20 through a spring plate 22. The plate 22 defines an abutment surface for one end of a plunger return spring 24, the other end of which engages with a step in the outer surface of the pump housing 16 between the enlarged 16*a* and reduced 16*b* diameter regions. At its lower end, the plunger 10 extends through, and is coaxial with, the return spring 24. The return spring 24 acts to provide a return spring force to the plunger 10 to effect a plunger return stroke, as will be described in further detail below, and is located within a return spring chamber 25. The return spring chamber 25 is vented to low pressure.

As the roller 18 rides over the cam surface it co-operates with the tappet 20 so as to impart a drive force to the tappet 20 and, hence, to the plunger 10. Tappet motion is guided by means of a guide bore 26 provided in an outer pump housing or sleeve 28 which is secured, at its upper end, to the unit pump housing 16. In an alternative embodiment (not shown) the sleeve may be removed, and instead the guide bore 26 may be provided directly within the engine block of the associated engine.

The pump chamber 12 communicates with one end of a first drilling provided in the upper region 16*a* of the unit pump housing 16. The first drilling defines a part of an outlet passage 30, or delivery passage, of the unit pump 8 through which high pressure fuel is supplied to a downstream common rail fuel volume of the fuel system. The common rail is not shown in FIG. 1, but it will be appreciated that it may take the form of any accumulator volume for receiving high pressure fuel and for supplying fuel to a plurality of injectors of the fuel system. For example, the common rail may be of the linear rail type, in which the accumulator volume takes the form of an elongate pipe, or may be of radial type, in which the accumulator volume has a central hub delivering fuel to a plurality of supply passages, each for supplying fuel to a different one of the injectors.

The outlet passage 30 of the pump assembly 8 is also defined by drillings provided in a valve housing 32, an insert 34 and a pump outlet housing 36, respectively. The pump outlet housing 36 is provided with a pump outlet 38 in communication with the common rail. The pump outlet 38 may communicate with the rail directly, or optionally through additional pipework, but with no further means for pumping fuel between the pump outlet 38 and the rail.

The pump outlet housing 36 is of generally U-shaped cross section, defining a downwardly extending annular wall and an internal end surface 43. The annular wall of the outlet housing 36 extends into a recess 40 provided at the upper end 16*a* of the unit pump housing 16. The recess 40 and the internal surface of the annular wall together define an internal chamber or housing space 42 within which the valve housing 32 and the insert 34 are received so that the valve housing 32 abuts the unit pump housing 16, at its uppermost end, and the insert 34 separates the valve housing 32 from the internal end surface 43.

The valve housing 32 forms part of an inlet metering valve arrangement, the housing 32 being provided with a valve bore 44 within which an elongate and generally cylindrical inlet valve member 46 is movable under the influence of an electromagnetic actuator arrangement. The electromagnetic actuator arrangement includes a winding 48 and an armature 50 that is coupled to the valve member 46. The armature 50 is provided with a through drilling 51 through which a part of the valve housing 32 extends. The part of the valve housing 32 which extends through the drilling 51 defines a portion of the outlet passage 30 for high pressure fuel. The valve housing 32 is mounted relative to the unit pump housing 16 so that the inlet valve member 46 is generally axially aligned with the plunger 10. It is a particular feature of the invention that the pump outlet 38 is aligned along a common axis with both the inlet valve member 46 and the plunger 10, so that all three components are generally co-axially aligned.

The inlet valve takes the form of a single seat, two position valve that is operable to control communication between the outlet from the pump chamber 12 (via the outlet passage 30) and a low pressure passage 52 defined within the valve housing 32. The passage 52 communicates with the housing space 42 which vents to low pressure.

Whether or not the outlet passage 30 communicates with the low pressure passage 52 is determined by the position of the valve member 46, which is movable between a first open state in which it is spaced from a valve seat (not identified) and a second closed state in which it seats against the valve seat. The inlet valve member 46 is biased towards its open state by means of a valve spring 54. In order to close the valve member 46, the winding 48 is energised so as to attract the armature 50 (i.e. movement of the armature in a downward direction in the illustration shown), thereby causing the valve member 46 to move against the spring force into engagement with the valve seat. If the winding 48 is de-energised, the valve spring 54 serves to urge the valve member 46 away from the valve seat and, hence, the valve member 46 is opened.

Mounted upon one side of the unit pump housing 16 is an electrical connector arrangement 56 for providing a current to the winding 48 to control energisation and de-energisation thereof to open and close the inlet metering valve 46, as required. A controller (not shown) for the pump 8 is arranged to provide the necessary control signals, via the connector 56, to operate the valve 46.

The region of the outlet passage 30 within the pump outlet housing 36 is provided with an outlet valve in the form of a hydraulically operable non-return valve 58 having a light non-return valve spring 60. The provision of the non-return valve 58 ensures high pressure fuel remains trapped within the common rail and cannot return to the outlet passage 30. Should fuel pressure within the outlet passage 30 exceed an amount that is sufficient to overcome fuel pressure in the rail (acting in combination with the spring force), the non return valve 58 is caused to open to permit high pressure fuel delivery through the pump outlet 38 and, hence, to the common rail.

The fuel pump 8 shown in FIG. 1 has several modes of operation. In each mode, as the cam is driven to rotate the roller 18 is caused to ride or roll over the cam surface, thereby imparting a drive force to the tappet 20, and hence to the plunger 10, resulting in reciprocating motion of these parts 10, 20. The plunger 10 performs a pumping cycle during which it is driven inwardly within its bore 14 to perform a pumping stroke and urged outwardly from its bore 14, under the force of the return spring 24, to perform a return stroke.

One mode of operation of the pump assembly of FIG. 1 will now be described. The winding 48 of the actuator is in a de-energised state at the start of the return stroke, so that the inlet valve member 46 is spaced away from the valve seat under the force of the valve spring 54. With the inlet metering valve open, continued movement of the plunger 10 through the return stroke causes fuel to be drawn into the pump chamber 12, filling the chamber 12 ready for the subsequent pumping stroke. Part way through the plunger return stroke, when the valve member 46 would otherwise be biased away from the valve seat due to the force of the spring 54, the winding 48 of the actuator is energised to cause the valve member 46 to seat. Closing the inlet metering valve part way through the return stroke provides a means for metering the quantity of fuel that is supplied to the pump chamber 12 and, thus, a means for metering the quantity of fuel that is pressurised during a subsequent pumping cycle; further movement of the plunger through the return stroke with the inlet metering valve 46 closed prevents any further fuel to be drawn into the pump chamber 12. The pump chamber 12 is therefore only filled for that period of the return stroke for which the inlet metering valve is open.

Throughout the plunger return stroke it will be appreciated that the non return valve 58 is held closed as the force due to high fuel pressure within the rail, acting in combination with the spring 60, overcomes the force due to fuel pressure within the outlet passage 30 (in practice the non return valve spring force is relatively low and provides a much less significant force than rail 20 pressure).

Once the plunger 10 has reached bottom-dead-centre and commences the subsequent pumping stroke, the inlet metering valve is maintained closed and fuel pressure within the pump chamber 12 starts to increase. During the initial part of the pumping stroke the non-return valve 58 will remain closed due to the pressure differential across it and the non return valve spring force holding it closed. At some point during the pumping stroke, fuel pressure within the pump chamber 12 will increase to a pressure level that is sufficient to cause the non-return valve 58 to open against the force of rail pressure (and the non-return valve spring 60). Pressurised fuel within the pump chamber 12 is therefore able to flow through the outlet passage 30, through the pump outlet 38 and into the common rail. The common rail communicates with the injectors of the fuel system, so as to permit fuel that is pressurised within the pump chamber 12 and supplied to the rail to be delivered to the injectors for injection. It will be appreciated that the quantity of fuel delivered through the pump outlet 38 to the rail during a pumping cycle is determined by that quantity of fuel supplied to the pump chamber 12 through the open inlet metering valve during the previous return stroke.

Once the plunger 10 has reached top-dead-centre and commences the subsequent return stroke, the winding 48 is de-energised to open the inlet metering valve once again, allowing the pump chamber 12 to re-fill during the return stroke, but only during an initial period of the return stroke, before closing the inlet valve again to ensure only the desired quantity of fuel is delivered to the pump chamber 12 for subsequent pressurisation. The inlet metering valve is preferably opened at or just after top-dead-centre.

The sequence of events may be continued, as described previously, for the subsequent pumping cycles.

The inlet metering valve 46 of the pump assembly is further operable to allow an alternative mode of pump operation, if desired, in which its metering function is modified. The pump controller may optionally control the inlet metering valve during the pumping stroke. In a second mode of operation, therefore, at the start of the return stroke the winding 48 is de-energised so that the inlet valve member 46 is spaced away from the valve seat under the force of the inlet valve spring 54. With the inlet metering valve 46 open, continued movement of the plunger 10 through the return stroke causes fuel to be drawn into the pump chamber 12, filling the chamber 12 ready for the subsequent pumping stroke. At bottom-dead-centre, the plunger is at its outermost position within the bore 14. The pump chamber 12 is filled with fuel at relatively low pressure and the winding 48 of the actuator is de-energised so that the inlet metering valve 46 is in its open state in which it is spaced from its valve seat. As described previously, during the plunger return stroke the non return valve 58 is held closed as the force due to high pressure fuel within the rail, acting in combination with the spring 60, overcomes the force due to fuel pressure within the outlet passage 30.

For an initial period of the pumping stroke (i.e. with the plunger 10 moving between bottom-dead-centre and top-dead-centre) the inlet metering valve 46 is maintained in its open state so that some of the fuel that has been supplied to the pump chamber 12 is dispelled back through the open inlet valve to low pressure. At this stage of the pumping stroke the non-return valve 58 will remain closed due to the pressure differential across it and the non return valve spring force holding it closed.

Following this initial period of the pumping stroke (i.e. to a point part way through the pumping stroke on the accelerating part of the cam) the winding 48 of the actuator is energised to move the inlet valve member 46 into engagement with the valve seat. Communication between the outlet passage 30 and the low pressure passage 52 is then broken. With the inlet metering valve 46 closed, the pumping plunger 10 continuing through the pumping stroke and the volume of the pump chamber 12 reducing, fuel pressure within the pump chamber 12 increases until a pressure level is reached that is sufficient to cause the non-return valve 58 to open against the force of rail pressure (and the non-return valve spring 60). Pressurised fuel within the pump chamber 12 is therefore able to flow through the outlet passage 30, through the pump outlet 38 and into the common rail. The common rail communicates with the injectors of the fuel system so as to permit fuel that is pressurised within the pump chamber 12 and supplied to the rail to be delivered to the injectors for injection.

Prior to the final period of the pumping stroke, and so before the plunger 10 reaches top-dead-centre, the inlet metering valve 46 is opened by de-energising the winding 48. When the inlet metering valve 46 is opened fuel pressure within the pump chamber 12 starts to reduce as communication is established between the outlet passage 30 and the low pressure passage 52. A point will be reached during the remainder of the plunger pumping stroke when the non return valve 58 is caused to close under the force of rail pressure and the non return valve spring 60, thus terminating the supply of fuel through the pump outlet 38 to the common rail. The inlet metering valve 46 is maintained in its open state during the subsequent plunger return stroke, to allow filling of the pump chamber 12 through the open valve 46, as described previously.

In summary, therefore, during this second mode of operation the inlet valve 46 is operable to control the quantity of fuel supplied to the rail by controlling how much low pressure fuel is displaced back through the open valve prior to commencement of pumping. With this in mind, it should be noted that reference to the 'plunger pumping stroke' is defined as the stroke of the plunger between bottom-dead-centre and top-dead-centre, and not just that period of the pumping cycle for which fuel pressurisation occurs.

It has been recognised that by using this mode of operation, with the inlet metering valve 46 being opened prior to the final period of the pumping stroke, an advantage is achieved in that Hertz stresses on the cam are minimised. This arises because the pump 8 is only in a "pumping mode" (i.e. when fuel pressure within the pump chamber 12 is increasing) during periods of the pumping cycle for which the roller 18 is co-operating with regions of the cam form having a large contact radius. In the aforementioned operation the inlet metering valve 46 is actuated to close only for a short period part way through the pumping stroke and, thus, the method provides an accurate means of controlling the timing of fuel delivery to the rail.

The step of opening the inlet metering valve 46 prior to the final period of the pumping stroke so as to reduce Hertz stresses on the cam may also be implemented, to provide the same advantage, when the valve is operated in its normal mode of metering the quantity of fuel supplied to the pump chamber 12 during the return stroke.

The net effect of the second mode of operation is the same as the first; control of the quantity of fuel that is pressurised and supplied to the common rail fuel volume during a pumping cycle. This is achievable through the normal metering operation of the inlet metering valve 46, in which only the required quantity of fuel is allowed to flow into the pump chamber 12 through the open valve, or through modified operation of the inlet metering valve 46 in which the pump chamber 12 is fully filled and then a proportion of fuel is dispelled back to low pressure during an initial part of the pumping stroke.

In a modification to this second mode of operation, the inlet metering valve 46 may be closed at an earlier stage of the pumping stroke, just after bottom-dead-centre and earlier on the accelerating part of the cam. Again the inlet metering valve 46 is opened just before the end of the pumping stroke to provide the aforementioned advantage of reducing Hertz stresses on the cam.

In a still further modification, the inlet metering valve 46 may be held closed until after the plunger 10 has passed top-dead-centre and commenced its return stroke. As the plunger 10 starts the return stroke, moving towards bottom-dead-centre, the pressure of fuel within the pump chamber 12 starts to fall and a point will be reached during the plunger return stroke at which the non return valve 58 is urged to close as the force due to fuel pressure within the rail, acting in combination with the spring 60, overcomes the force due to fuel pressure within the outlet passage 30. When it is required to commence filling of the pump chamber 12, ready for the next pumping stroke, the winding 48 of the actuator is de-energised causing the valve member 46 to move away from the valve seat under the force of the valve spring 54. With the inlet metering valve 46 open, continued movement of the plunger 10 through the return stroke causes fuel to be drawn into the pump chamber 12 ready for the subsequent pumping stroke. As described previously, having reached bottom-dead-centre at the end of the return stroke (i.e. just prior to commencement of the next pumping stroke), the plunger 10 starts to move inwardly within the bore 14 causing some of the fuel that has filled the chamber 12 during the return stroke to be dispelled back to low pressure. The inlet metering valve 46 is then closed, in this case at a relatively late stage of the pumping stroke, and remains closed until just after top-dead-centre, as mentioned before.

It will be appreciated that in all modes of operation described previously, the inlet valve 46 controls the quantity of fuel that is pressurised within the pump chamber 12 during the pumping stroke. This may achieved by operating the inlet metering valve 46 during the return stroke to allow fuel supply to the pump chamber 12 during only a part of the return stroke or, optionally, by controlling the inlet metering valve 46 so as to allow fuel to flow into the pump chamber 12 throughout the return stroke and then dispelling a portion of fuel from the pump chamber 12 during an initial period of the subsequent pumping stroke.

The pump assembly is advantageous in that it can be readily incorporated into existing engine installations, for example unit pump type installations, where the available accommodation space is limited. The pump assembly of the system is also relatively compact, particularly due to the inlet valve and its actuator (i.e. the inlet valve member 46, the armature 50 and the winding 48) being located co-axially with the plunger 10, and being mounted within a housing 32 adjacent to, and directly on top of, the unit pump housing 16 for the plunger 10 and its associated drive components 18, 20. The fuel system therefore provides size and weight benefits also. Pump efficiency is good as there is no necessity to spill pressurised fuel to low pressure to control the quantity of fuel supplied to the rail; the use of the inlet metering valve 46 in the manner described avoids this disadvantage.

An alternative embodiment of the pump assembly is shown in FIG. 2. Similar parts to those shown in FIG. 1 are identified with like reference numerals and will not be described in further detail. In FIG. 2, the fuel pump 8 further includes a filling port 64 for the pump chamber 12 defined at one end of a filling passage 62 provided within the unit pump housing 16. The filling passage 62 communicates, at its end remote from the filling port 64, with a low pressure fuel supply or reservoir (not shown) so that as the plunger 10 reciprocates within the plunger bore 14 co-operation between its outer surface and the filling port 64 provides a supplementing fuel supply to the pump chamber 12 by controlling the supply of low pressure fuel through the filling passage 62 to the pump chamber 12.

The filling port 64 is positioned along the plunger bore axis so as to be uncovered by the plunger 10 only during an end period of the return stroke, typically over a plunger travel distance of, for example, between 2 and 4 mm. Fuel supply to the pump chamber 12 through the port 64 therefore only occurs during the end period of the plunger return stroke.

Filling of the pump chamber 12 through the inlet metering valve 46 occurs during the return stroke when the valve member 46 is unseated and, additionally, through the filling port 64 when it is uncovered by the plunger 10. Supplementary filling of the pump chamber 12 through the filling port 64 only occurs, however, if the pump chamber 12 is not already full at the point in the return stroke when the port 64 is uncovered, for example if supply pressure is too low to fill the pump chamber 12 completely through the inlet metering valve 46.

In one mode of operation the valve member 46 is held open for an initial period of the pumping stroke and is only closed after the point at which the filling port 64 has been closed by the plunger 10. During this initial period some of the fuel within the pump chamber 12 will be dispelled back to low pressure through the open inlet valve, and additionally through the filling passage 62 (until the port 64 is closed by the plunger 10), as the plunger 10 continues through the pumping stroke. When it is required to supply pressurised fuel to the common rail, the winding 48 is energised to cause the inlet valve member 46 to seat against the inlet valve seat, thus closing the inlet valve. As the filling port 64 is already closed at this time, closure of the inlet valve causes pressure within the pump chamber 12 to increase. Subsequently, the non-return valve 58 will open and, hence, fuel at high pressure is delivered through the pump outlet 38 to the common rail.

In an alternative mode of operation, the winding 48 is energised to seat the inlet valve member 46 at an earlier stage of the pumping cycle, and before the plunger 10 has closed the port 64. In such circumstances it is closure of the port 64 by the plunger 10 that causes pressurisation of fuel within the chamber 12, subsequent opening of the non-return valve 58 and, hence, high pressure fuel delivery through the pump outlet 38 to the common rail.

In both the first and second modes of operation of the fuel pump 8 in FIG. 2, the winding 48 is de-energised before the final period of the plunger pumping stroke (i.e. prior to top-dead-centre), causing the non return valve 58 to close to trap high fuel pressure within the common rail. As mentioned before, the benefit of using this method is that Hertz stresses on the cam are minimised as the plunger 10 is only pumping during periods for which the roller 18 is co-operating with regions of the cam form having a large contact radius.

In a third alternative mode of operation of the fuel pump 8 in FIG. 2, the winding 48 is energised at a later stage of the pumping stroke, after the filling port 64 is closed, so as to seat the valve member 46. Subsequently, the non-return valve 58 will open and, hence, fuel at high pressure is delivered through the pump outlet 38 to the common rail. The valve member 46 is held in this position for the remainder of the pumping stroke and so that fuel delivery to the rail continues until plunger top-dead-centre. Only after the plunger 10 has commenced the return stroke is the winding de-energised to unseat the inlet valve member 46, thus permitting filling of the pump chamber 12 through the inlet valve ready for the subsequent pumping stroke. The non return valve 58 is caused to close to trap fuel pressure in the rail at just about plunger top-dead-centre.

It will be appreciated that the reference in this document to the plunger 10, the inlet valve member 46 and the pump outlet 38 being generally co-axially aligned is intended to include arrangements where one component may be slightly off-axis, in particular due to manufacturing tolerances, but where nonetheless the plunger 10, inlet metering valve 46 and the pump outlet 38 are arranged in an approximately linear and compact manner within a single unit pump assembly 8.

The invention claimed is:

1. A common rail fuel pump for supplying fuel to a common rail fuel volume of an internal combustion engine, the fuel pump comprising:

a pumping plunger that is reciprocable within a plunger bore provided in a pump housing under the influence of a cam drive arrangement to cause fuel pressurization within a pump chamber, wherein the drive arrangement includes a cam driven drive member coupled to the plunger to impart drive thereto, in use, so that the plunger performs a pumping cycle including a pumping stroke and a return stroke;

an inlet metering valve operable to permit control of the quantity of fuel supplied to the pump chamber during the return stroke of the plunger; and an outlet valve for controlling the supply of pressurized fuel from the pump chamber, through an outlet passage to the common rail fuel volume during the pumping stroke in circumstances in which the inlet metering valve is closed;

wherein the outlet passage communicates with a pump outlet that is substantially co-axially aligned with the inlet metering valve and the plunger;

wherein the inlet metering valve is operable: i) to open during the return stroke to permit fuel to be supplied to the pump chamber from a low pressure source, and ii) to close part way through the return stroke in order to meter the quantity of fuel that is supplied to the pump chamber during the return stroke.

2. The common rail fuel pump as claimed in claim 1, wherein the inlet metering valve comprises an elongate inlet valve member that is co-axially aligned with the plunger.

3. The common rail fuel pump as claimed in claim 1, wherein the inlet metering valve is housed within a valve housing, the valve housing being arranged so chat respective drillings provided in the valve housing and the pump housing align to define, at least in part, the outlet passage.

4. The common rail fuel pump as claimed in claim 1, wherein the outlet valve of the pump assembly is a hydraulically operable non-return valve located within the outlet passage.

5. The common rail fuel pump as claimed in claim 1, the inlet metering valve being further operable to allow opening thereof during the return stroke to permit filling of the pump chamber and to allow closure thereof following an initial period of the pumping stroke, thereby to permit a quantity of fuel within the pump chamber to be dispelled through the inlet metering valve to low pressure during the initial period.

6. The common rail fuel pump as claimed in claim 1, wherein the inlet metering valve is further operable to allow opening thereof prior to a final period of the pumping stroke so as to minimize Hertz stresses on a cam of the cain drive arrangement.

7. The common rail fuel pump as claimed in claim 1, wherein the plunger bore is provided with filling port, and wherein the plunger is co-operable with the filling port so that, when the plunger covers the filling port, fuel is unable to flow into the pump chamber through the filling port, and so that, when the plunger uncovers the filling port, fuel is able to flow into the pump chamber through the filling port.

8. The common rail fuel pump as claimed in claim 7, wherein the filling port is defined at one end of a filling passage provided in the pump housing, wherein said filling passage communicates with a low pressure fuel reservoir.

9. The common rail fuel pump as claimed in claim 1, wherein the inlet metering valve is a two-position, single seat valve.

10. A common rail fuel supply system, for use in an internal combustion engine, the system comprising a common rail fuel volume for supplying fuel to a plurality of fuel injectors of the engine and at least one common rail fuel pump, wherein said at least one common rail fuel pump comprises:

a pumping plunger that is reciprocable within a plunger bore provided in a pump housing under the influence of a cam drive arrangement to cause fuel pressurization within a pump chamber, wherein the drive arrangement includes a cam driven drive member coupled to the plunger to impart drive thereto, in use, so that the plunger performs a pumping cycle including a pumping stroke and a return stroke;

an inlet metering valve operable to permit control of the quantity of fuel supplied to the pump chamber during the return stroke of the plunger; and an outlet valve for controlling the supply of pressurized fuel from the pump chamber, through an outlet passage to the common rail fuel volume during the pumping stroke in circumstances in which the inlet metering valve is closed;

wherein the outlet passage communicates with a pump outlet that is substantiauy co-axially aligned with the inlet metering valve and the plunger;

wherein the inlet metering valve is operable: i) to open during the return stroke to permit fuel to be supplied to the pump chamber from a low pressure source, and ii) to close part way through the return stroke in order to meter the quantity of fuel that is supplied to the pump chamber during the return stroke; and wherein the or each common rail fuel pump is arranged to supply fuel through a respective pump outlet to the common rail fuel volume.

11. The common rail fuel supply system as claimed in claim 10, further comprising a plurality of common rail fuel pumps.

12. A control method for a common rail fuel pump as claimed in claim 1 comprising the steps of:

holding the inlet metering valve open during the return stroke to permit fuel to be supplied to the pump chamber from a low pressure source, closing the inlet valve to permit pressurization of fuel within the pump chamber during the subsequent pumping stroke, and opening the inlet metering valve prior to a final period of the pumping stroke so as to terminate pressurization of fuel within the pump chamber and to ensure Hertz stresses on a cam of the cam drive arrangement are minimized.

13. The control method as claimed in claim 12, further comprising the step of closing the inlet metering valve after an initial period of the pumping stroke so as to dispel a proportion of fuel that is supplied to the pump chamber during the return stroke back to low pressure, thereby to control the quantity of fuel which is pressurized within the pump chamber during the pumping cycle.

* * * * *